US008646857B2

(12) United States Patent
Schillkowski

(10) Patent No.: US 8,646,857 B2
(45) Date of Patent: Feb. 11, 2014

(54) REFRIGERATOR AND/OR FREEZER

(75) Inventor: Dieter Schillkowski, Ochsenhausen (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 877 days.

(21) Appl. No.: 12/284,214

(22) Filed: Sep. 19, 2008

(65) Prior Publication Data

US 2009/0126395 A1 May 21, 2009

(30) Foreign Application Priority Data

Sep. 20, 2007 (DE) ..... 20 2007 013 170 U

(51) Int. Cl.
*A47B 96/04* (2006.01)

(52) U.S. Cl.
USPC ..... 312/401

(58) Field of Classification Search
USPC ..... 312/107.5, 216, 401, 408, 236, 351, 312/217, 218, 219
See application file for complete search history.

(56) References Cited

U.S. PATENT DOCUMENTS

| | | | | | |
|---|---|---|---|---|---|
| 944,513 | A | * | 12/1909 | Selden | 312/216 |
| 1,482,029 | A | * | 1/1924 | Owen, Jr. | 312/216 |
| 1,486,242 | A | * | 3/1924 | Greene | 312/216 |
| 2,465,806 | A | * | 3/1949 | Jewell | 211/153 |
| 2,659,648 | A | | 11/1953 | Robbins | |
| 3,222,114 | A | * | 12/1965 | Stentz | 312/403 |
| 3,583,671 | A | * | 6/1971 | Hufford | 251/367 |
| 3,859,932 | A | * | 1/1975 | Armstrong et al. | 108/75 |
| 4,936,641 | A | * | 6/1990 | Bussan et al. | 312/408 |
| 5,205,628 | A | * | 4/1993 | Swets et al. | 312/216 |
| 5,503,440 | A | * | 4/1996 | Peccoux | 292/158 |
| 5,611,553 | A | * | 3/1997 | Schoeman et al. | 280/47.35 |
| 5,775,269 | A | * | 7/1998 | Lawrence | 122/511 |
| 5,862,689 | A | * | 1/1999 | Wen | 70/85 |
| 6,036,803 | A | | 3/2000 | Lasson et al. | |
| 6,135,030 | A | * | 10/2000 | Besaw | 108/51.3 |
| 6,722,167 | B1 | * | 4/2004 | Hsu | 70/78 |
| 6,736,468 | B1 | * | 5/2004 | Wilson | 312/217 |
| 2001/0041764 | A1 | * | 11/2001 | Kielhorn-Bayer et al. | 524/432 |
| 2005/0008801 | A1 | * | 1/2005 | Kippenhahn et al. | 428/35.7 |
| 2006/0027316 | A1 | * | 2/2006 | Jung et al. | 156/272.2 |
| 2006/0181182 | A1 | * | 8/2006 | Hung | 312/218 |
| 2006/0218958 | A1 | * | 10/2006 | Rand et al. | 62/302 |
| 2008/0278043 | A1 | * | 11/2008 | Holcomb | 312/219 |

FOREIGN PATENT DOCUMENTS

| | | |
|---|---|---|
| DE | 1101271 | 3/1961 |
| DE | 8111727 | 7/1981 |
| DE | 9106996 | 7/1991 |
| DE | 29507993 | 7/1995 |
| DE | 19621542 | 12/1997 |
| DE | 20 2006 019 376 | 4/2007 |
| DE | 20 2006 019373 | 5/2007 |
| RU | 2107624 C1 | 3/1998 |

* cited by examiner

*Primary Examiner* — Matthew Ing
(74) *Attorney, Agent, or Firm* — Dilworth & Barrese, LLP.

(57) ABSTRACT

A refrigerator and/or freezer has at least one door or flap, by which the appliance interior can be closed, with at least one supporting tray disposed in the appliance interior and with at least one first and at least one second transport lock, wherein the first transport lock is configured and arranged such that its front side adjoins the supporting tray and it adjoins the second transport lock at least when the door or flap is closed.

24 Claims, 4 Drawing Sheets

REFRIGERATOR AND/OR FREEZER

BACKGROUND OF THE INVENTION

The present invention relates to a refrigerator and/or freezer with at least one door or flap by means of which the appliance interior can be closed, with at least one supporting tray disposed in the appliance interior and with a transport lock.

Such refrigerator and/or freezer is known for instance from DE 196 21 542 A1. The transport lock known from this document is configured as a formation rectangular in cross-section, which includes receptacles by means of which the transport lock is pushed onto the front sides of the supporting trays. When the door of the appliance is closed, the transport lock fixes the supporting trays.

SUMMARY OF THE INVENTION

It is the object underlying the present invention to develop a refrigerator and/or freezer as mentioned above such that the transport lock can also be used for elements of the appliance to be secured in different ways and thus can be used flexibly.

This object is solved by a refrigerator and/or freezer with the features herein.

Accordingly, a first transport lock and a second transport lock are provided, wherein the first transport lock is configured and arranged such that its front side adjoins the supporting tray and that it adjoins the second transport lock at least when the door or flap is closed. The term "adjoining" also is meant to include the case that the second transport lock is received in a receptacle of the first transport lock or is connected with the same in some other way.

The first transport lock can extend parallel or substantially parallel to the supporting tray to be secured.

This aspect of the invention is relevant in particular for refrigerators and/or freezers whose supporting trays have different depths. It is conceivable, for instance, to arrange the first transport lock such that its front side extends from that or those supporting tray or trays which have a smaller depth than further supporting trays of the appliance.

At this point, it should be noted that the term "supporting tray" should be interpreted widely and also includes all kinds of functional elements and accessories of the appliance.

The second transport lock can extend vertical or substantially vertical relative to the supporting trays.

In a preferred aspect of the invention it is provided that the first transport lock includes one or more mounting regions, with which it rests on supports, in particular on ribs of the inner container of the appliance, or is positively connected with the same or encloses the same.

The first transport lock furthermore can have an upper surface, wherein the mounting region(s) is(are) set back with respect to the lateral edge(s) of the upper surface. It is conceivable for instance that the upper surface of the transport lock rests on the ribs at its edge portions, whereas the mounting regions extend at the level of the ribs and preferably are positively connected with the same.

For fixation, the first transport lock can have at least one region which in the inserted condition of the first transport lock rests on the surface of the supporting tray to be secured.

In the mounted condition of both transport locks, the second transport lock can rest against the first transport lock. Alternatively or in addition, the second transport lock furthermore can include receptacles in which further supporting trays are at least partly received. The second transport lock thus can be an element which at different levels includes receptacles, for instance grooves, in which front-side portions of supporting trays are received. Furthermore, it can be provided that the second transport lock likewise receives the first transport lock in a groove or in some other mounting region. In principle, it is also conceivable that the first and second transport locks substantially rest against each other.

In a further aspect of the invention it is provided that the second transport lock is configured and arranged such that when the door or flap is closed, it rests against the inside of the door or flap or against accessories such as door shelves or the like, which are disposed thereon. This leads to the fact that the second transport lock and thereby also the first transport lock can be fixed in the specified position when the door or flap is closed.

In a preferred aspect it is provided that the second transport lock is configured triangular, square, semicircular or trapezoidal in cross-section.

The present invention furthermore relates to a refrigerator and/or freezer with a plurality of supporting trays, wherein at least two of the supporting trays have different depths. In accordance with the invention, at least one transport lock is provided, which adjoins the front side of the supporting tray(s) of smaller depth such that it completely or partly fills the region by which the supporting tray(s) of smaller depth is(are) set back with respect to the supporting tray(s) of greater depth.

Preferably, this transport lock is configured in accordance with the first transport lock as described herein.

This invention furthermore relates to a refrigerator and/or freezer with at least one supporting tray and with at least one drawer. In accordance with the invention, it is provided in this aspect of the invention that at least one transport lock is provided, which is configured such that in the mounted condition it serves both as transport lock of said supporting tray and as transport lock of the drawer. Alternatively or in addition, the transport lock can be configured such that it is attached to the supporting tray and includes at least one portion which fixes the drawer. The portion can be arranged such that in pull-out direction of the drawer it is arranged before the same and hence serves as pull-out lock.

The transport lock of the drawer substantially can be formed by a protruding tab, which extends in the vicinity of the front side of the drawer.

The transport lock can frictionally be connected with the inner container of the appliance. It is conceivable that in one or both of its lateral regions the transport lock includes portions which extend along the inner wall of the appliance.

The present invention furthermore relates to a refrigerator and/or freezer with at least one supporting tray and with at least one transport lock which includes a region in which one or more receptacles are provided for receiving portions of the supporting tray(s), wherein the transport lock is configured triangular, semicircular or trapezoidal in cross-section.

The transport lock in accordance with the present invention can be made of a foldable material, in particular of cardboard. The board can have a coating, wherein the coating can constitute a film, a paper coating or a wax coating.

The foldable material, i.e. in particular the board, can have latching elements, by means of which the folded transport lock is fixed in its arrangement.

The present invention furthermore relates to a refrigerator and/or freezer with at least one transport lock arranged in the interior of the appliance for securing objects disposed in the interior of the appliance, such as supporting trays or drawers, wherein the transport lock has a coating of a material which reduces the friction between the transport lock and the objects to be secured as compared to an uncoated transport lock.

The coating can for instance constitute a film coating in the form of alternative paper, such as chromo duplex, or a wax coating. The transport lock itself can for instance constitute a single-wall, multi-wall corrugated board or also a solid board.

BRIEF DESCRIPTION OF THE DRAWINGS

Further details and advantages of the invention will be explained in detail with reference to an embodiment illustrated in the drawing, in which.

DESCRIPTION OF THE PREFERRED EMBODIMENTS

Figure 1:
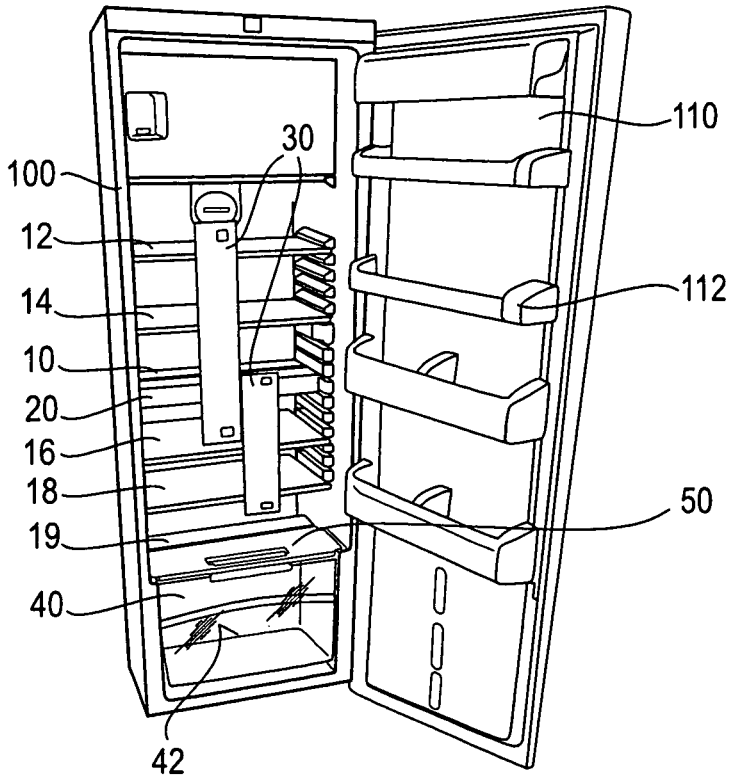
FIGS. 1 to 4: show refrigerators or refrigerators and freezers in accordance with the present invention in a perspective view with open door.
Figure 2:
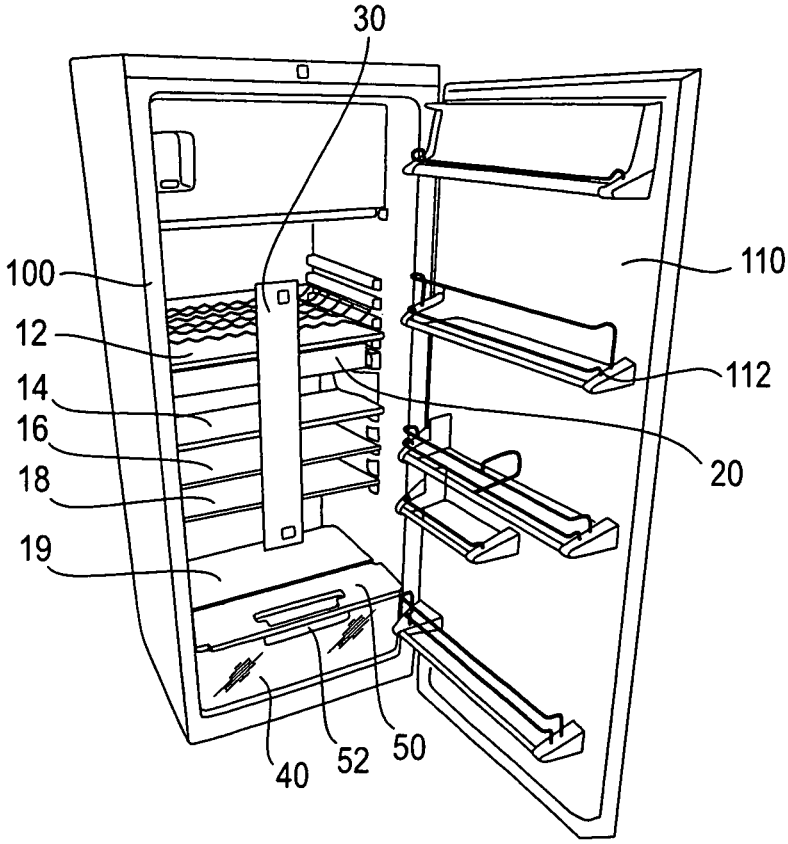
Figure 3:
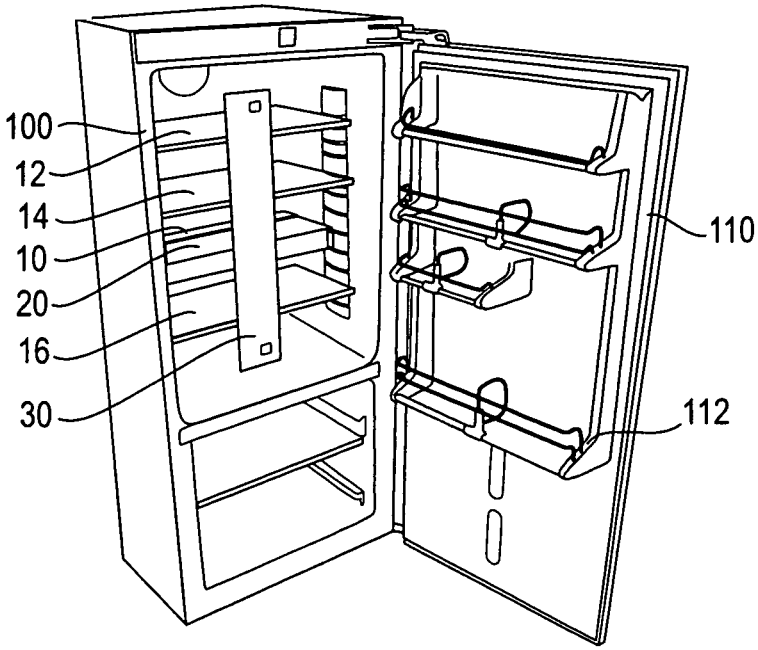
Figure 4:
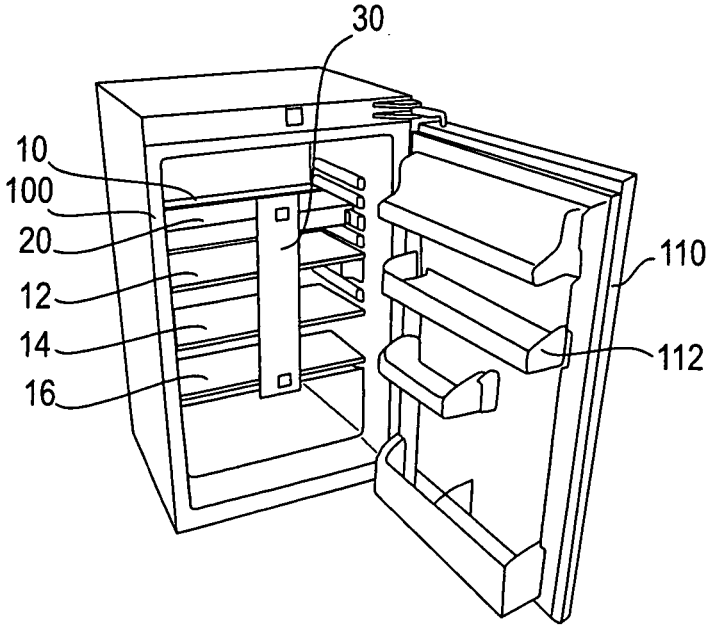

FIG. 1 shows the interior of the refrigerator and freezer 100 with open door 110. As can be taken from FIG. 1, supporting trays 10, 12, 14, 16, 18 and 19—supported on ribs of the inner container—are provided in the interior of the appliance. While the supporting trays 12, 14, 16, 18, 19 have a comparatively great depth and completely or largely utilize the depth of the inner container, the supporting tray 10 is a tray with reduced depth. It is conceivable that the depth of the supporting tray 10 is half the depth of the further supporting trays of the appliance.

Said supporting trays can for instance be configured as glass plates, but another configuration also is conceivable.

Reference numeral 40 designates a drawer which extends below the bottommost supporting tray 19. The front side of the drawer is designated with the reference numeral 42.

Figure 5:
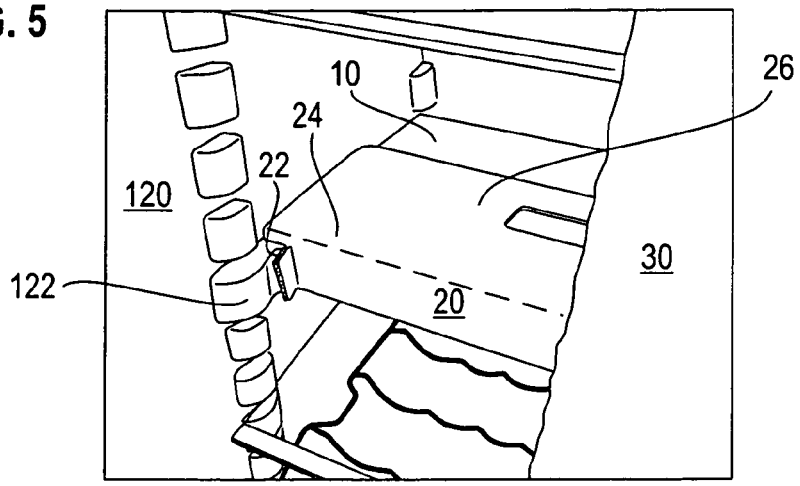
FIG. 5: shows a detailed representation of a transport lock for securing a supporting tray of small depth.

As can be taken in particular from the detailed representation of FIG. 5, the first transport lock 20 is provided on the front side of the supporting tray 60. The transport lock 20 has an upper surface 24/26, which at its edge portions rests on the rib 122 of the inner container 120 and which furthermore rests on the upper surface of the supporting tray 10. The first transport lock 20 includes mounting regions 22 set back with respect to the edge portion of the upper surface 24. With the mounting regions 22, the first transport lock 20 encloses the ribs 122 of the inner container 120 and thus is positively connected with the inner container 120. The portion 26 of the first transport lock 20 rests on the upper surface of the supporting tray 10.

As can furthermore be taken from FIGS. 1 to 4 and in particular from the detailed representation of FIG. 5, the depth of the supporting trays 12, 14, 16, 18, 19 is greater than the depth of the supporting tray 10 provided with the first transport lock 20. This means that the front side of the first transport lock 20 is set back with respect to the front side of the supporting trays 12, 14, 16, 18, 19.

Figure 6:
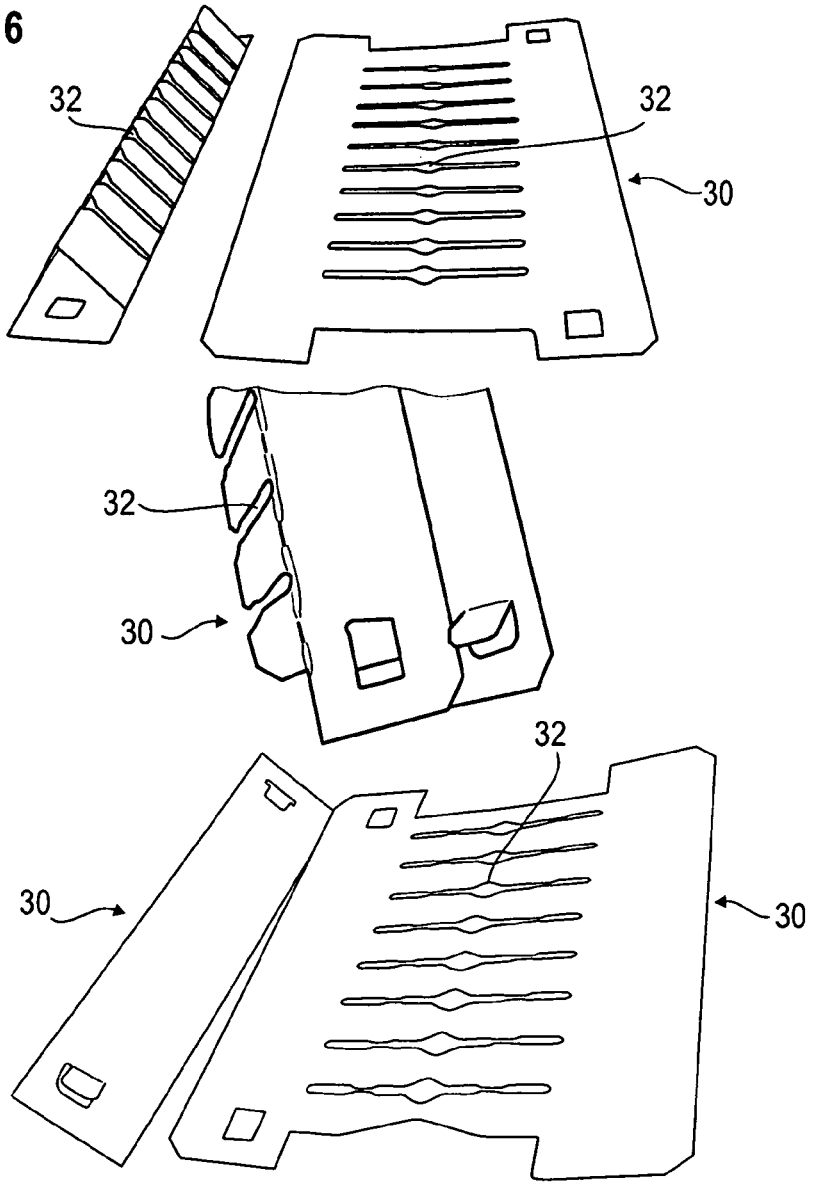
FIG. 6: shows different representations of the second transport lock.

As can furthermore be taken from FIGS. 1 to 4, one or more second transport locks 30 are disposed in the interior of the appliance. These second transport locks 30 consist of a formation triangular in cross-section, which in FIG. 6 is shown in different perspectives in the not yet folded condition and in the folded condition. The second transport lock 30 includes slotted receptacles 32, which are provided at different levels of the second transport lock 30. The receptacles 32 can be uniformly spaced from each other. A division with different spacings also is conceivable. The receptacles 32 of the second transport lock 30 are pushed onto the front sides of the trays 12, 14, 16, 18 of greater depth, i.e. these supporting trays are received in the receptacles 32 in a portion of their front side.

The second transport lock 30 furthermore serves to secure the first transport lock 20. Such locking is effected in that in its region facing away from the front side, the second transport lock 30 adjoins the front side of the first transport lock 20. In contrast to the trays 12, 14, 16, 18 of greater depth, the first transport lock 20 thus is not received in a recess of the second transport lock 30, but rests against the same. Of course, it is likewise conceivable to provide a recess for receiving the first transport lock 20 in the second transport lock 30.

Figure 7:
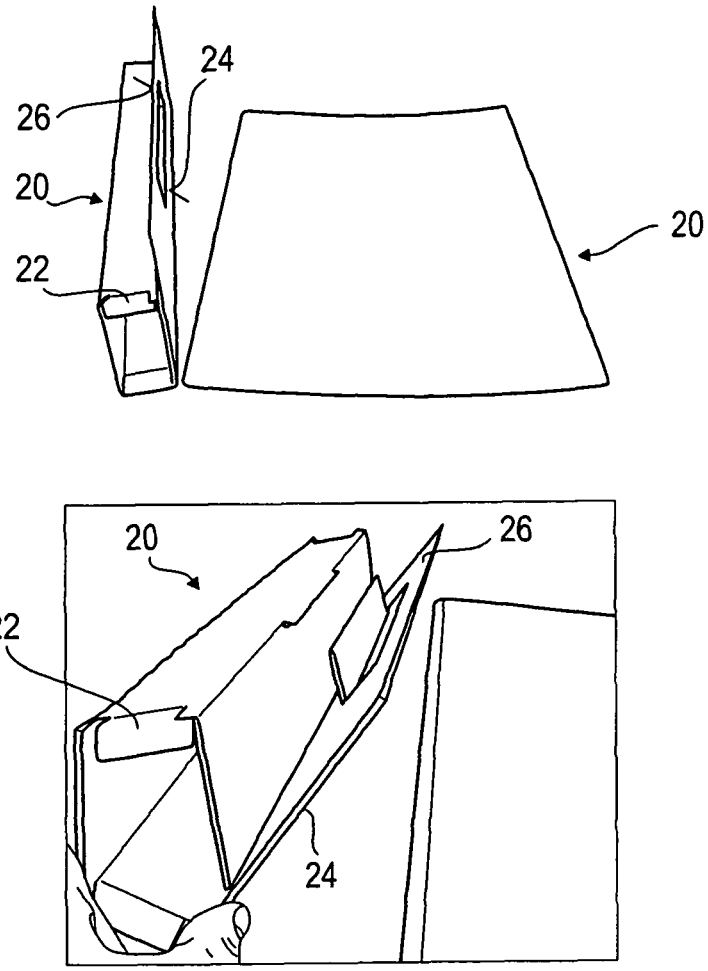
FIG. 7: shows different representations of the first transport lock.

FIG. 7 shows the first transport lock 20 in different representations and different conditions (folded and non-folded). The same has a substantially rectangular cross-section, whose one wall is formed by the upper surface 24. In a region 26, the upper surface 24 protrudes beyond the rectangular body, as can be taken from FIG. 7.

FIG. 1 furthermore shows that the refrigerator includes a drawer 40 which is arranged below the supporting tray 19. Reference numeral 50 designates a transport lock which on the one hand secures the supporting tray 19 and on the other hand the drawer 40.

Figure 8:
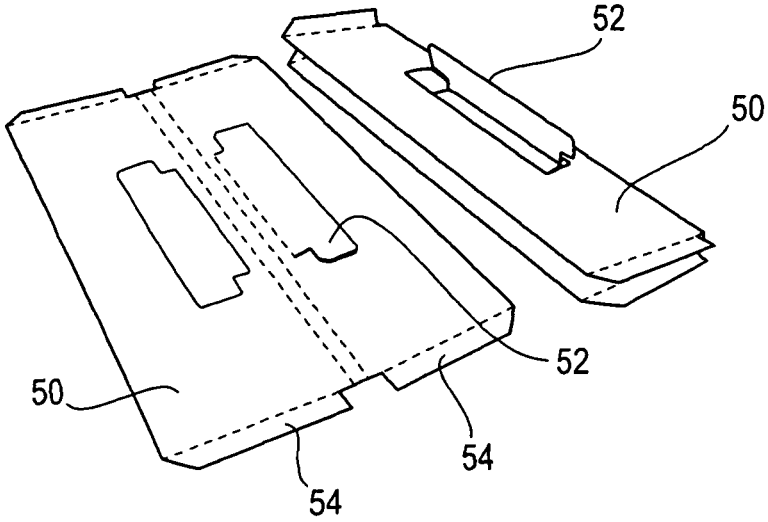
FIG. 8: shows different representations of the transport lock for securing a drawer.

FIG. 8 shows the transport lock 50 in different representations and conditions (folded and non-folded). In its two edge portions, the transport lock 50 includes portions 54 which in the mounted condition extend at right angles with respect to the surface of the transport lock 50 and rest against the inner container 120. In this way, a sufficient frictional locking of the tray 19, onto which the transport lock 50 is pushed, is realized.

As can furthermore be taken from FIG. 8 and also from FIG. 1, the tab 52 protrudes from the plane of the transport lock 50. The transport lock 50 is configured such that the tab 52 prevents the drawer 40 disposed below the tray 19 from slipping out. This is achieved in that the tab 52 is arranged in the vicinity of the front side 42 of the drawer 40 or adjoins the same.

As can be taken from FIGS. 6 to 8, the transport locks of the present invention are made of cardboard, which is folded and in the folded condition can be retained by retaining means, wherein the retaining means preferably are configured such that they ensure a locking of the transport means in the folded position.

The present invention relates to different kinds of refrigerators and/or freezers and also comprises for instance wine storage cabinets.

The transport lock in accordance with the present invention preferably provides a positive and inexpensive transport protection protected against damage.

The solution in accordance with the invention is largely independent of external conditions, such as for instance its careful assembly, of the surface properties of the components to be secured, of cleaning agents, moisture, etc.

In a preferred aspect of the invention, it is also possible to not only secure trays of the same depth, but also trays or other functional elements of different depth.

In a preferred aspect of the invention, a film-coated, foldable and latchable corrugated board is employed. The corrugated board can be a single-wall and film-coated board, in order to prevent scouring of the corrugated board on the components to be secured. In principle, a multi-wall corrugated board or even a solid board also is conceivable.

In the case of insensitive surfaces, the film coating might also be omitted.

As a protection against surface friction, alternative papers such as chromo duplex, wax-coated papers, etc. might also be used.

Due to the self-retention possible with the transport lock of the invention, adhesive tapes as they have been used so far can completely or at least partly be omitted.

In a preferred aspect of the invention, the transport lock is mounted free from play.

If the second transport lock is configured triangular in cross-section, a particularly high inherent stability is obtained.

A further advantage of the solution in accordance with the invention in the form of corrugated board is the fact that the same is recyclable even as film-coated corrugated board.

The invention claimed is:

1. A refrigerator and/or freezer (100) with at least one door or flap (110), by which the appliance interior can be closed, with at least one supporting tray (10) disposed in the appliance interior, and at least one first (20) and at least one second transport lock (30) separately-mounted apart from one another and always mounted within the appliance interior whether the at least one door or flap (110) is open or closed, wherein the first transport lock (20) is configured and arranged on a front side of the supporting tray (10) such that its front side adjoins the supporting tray (10) and rests against the second transport lock (30) when the door or flap (110) is closed.

2. The refrigerator and/or freezer (100) according to claim 1, wherein the first transport lock (20) extends parallel or substantially parallel to the supporting tray (10).

3. The refrigerator and/or freezer (100) according to claim 1, wherein the second transport lock (30) extends vertical or substantially vertical to the supporting tray (10).

4. The refrigerator and/or freezer (100) according to claim 1, wherein the first transport lock (20) has one or more mounting regions (22), with which it encloses ribs (122) protruding from the inner container (120) of the appliance (100) to form a positive, non-pivotal connection therewith.

5. The refrigerator and/or freezer (100) according to claim 4, wherein the first transport lock (20) has an upper surface (24) and the mounting region(s) (22) are set back with respect to the lateral edge(s) of the upper surface (24).

6. The refrigerator and/or freezer (100) according to claim 1, wherein the first transport lock (20) has at least one region (26) which in the inserted condition of the first transport lock (20) rests on the surface of the supporting tray (10).

7. The refrigerator and/or freezer (100) according to claim 1, wherein the supporting tray (10) on whose front side the first transport lock (20) extends has a smaller depth than further supporting trays (12, 14, 16, 18) which are secured by the second transport lock (30).

8. The refrigerator and/or freezer (100) according to claim 1, wherein the second transport lock (30) is configured triangular, square, semicircular or trapezoidal in cross-section.

9. The refrigerator and/or freezer (100) according to claim 1, wherein the first and second transport locks (20, 30, 50) are made of cardboard.

10. The refrigerator and/or freezer (100) according to claim 9, wherein the cardboard has a coating, wherein the coating constitutes a film, paper or wax.

11. The refrigerator and/or freezer (100) according to claim 9, wherein the cardboard includes latching elements, by which the folded material is fixed in its arrangement.

12. A refrigerator and/or freezer (100) with at least one door or flap (110), by which the appliance interior can be closed, with at least one supporting tray (10) disposed in the appliance interior, and at least one first (20) and at least one second transport lock (30) separately-mounted apart from one another, wherein the first transport lock (20) is configured and arranged such that its front side adjoins the supporting tray (10) and rests against the second transport lock (30) when the door or flap (110) is closed, and in the mounted condition of both transport locks (20, 30) the second transport lock (30) rests against the first transport lock (20) and furthermore includes receptacles (32) in which further supporting trays (12, 14, 16, 18) are at least partly received.

13. A refrigerator and/or freezer (100) with at least one door or flap (110), by which the appliance interior can be closed, with at least one supporting tray (10) disposed in the appliance interior, and at least one first (20) and at least one second transport lock (30) separately-mounted apart from one another, wherein the first transport lock (20) is configured and arranged such that its front side adjoins the supporting tray (10) and rests against the second transport lock (30) when the door or flap (110) is closed, and the second transport lock (30) is configured and arranged such that when the door or flap (110) is closed, it rests against the inside of the door or flap (110) or on door shelves (112) which are disposed thereon.

14. The refrigerator and/or freezer (100) with a plurality of supporting trays (10, 12, 14, 16, 18), wherein at least two of the supporting trays (10; 12, 14, 16, 18) have a different depth, and at least one transport lock (20) is provided at a front, open side of the refrigerator and/or freezer (100) and which continuously adjoins the front side of the supporting tray(s) (10) of smaller depth such that it completely or partly fills the region, by which the supporting tray(s) (10) of smaller depth is(are) set back with respect to the supporting tray(s) (12, 14, 16, 18) of greater depth.

15. The refrigerator and/or freezer (100) according to claim 14, wherein the transport lock (20) is configured as the first transport lock (20) extending parallel or substantially parallel to the supporting tray (10).

16. The refrigerator and/or freezer (100) with at least one supporting tray (19) and with at least one drawer (40), wherein at least one transport lock (50) is provided, which is configured such that in the mounted condition it serves both as a transport lock of the supporting tray (19) and as a transport lock of the drawer (40) from respective different directions perpendicular to one another.

17. The refrigerator and/or freezer (100) according to claim 16, wherein the portion is configured as a protruding tab (52), which extends in the vicinity of the front side (42) of the drawer (40).

18. The refrigerator and/or freezer (100) according to claim 16, wherein the transport lock (50) includes a receptacle by which the transport lock (50) is pushed onto the supporting tray (19).

19. The refrigerator and/or freezer (100) according to claim 16, wherein the transport lock (50) is positively connected with the inner container (120) of the appliance (100).

20. The refrigerator and/or freezer (100) according to claim 16, wherein in one or both of its lateral regions the transport lock (50) includes portions (54) which extend along the inner wall of the appliance (100).

21. The refrigerator and/or freezer (100) according to claim 16, wherein the transport lock (50) has a film coating of chromo duplex paper which reduces the friction between the transport lock and the supporting trays (10, 12, 14, 16, 18, 19) or drawers (40) to be secured as compared to an uncoated transport lock.

22. The refrigerator and/or freezer (100) according to claim 16, wherein transport lock (50) is additionally attached to the supporting tray (19) and has at least one portion which is arranged such that the same is arranged before the drawer (40) in pull-out direction thereof.

23. The refrigerator and/or freezer (100) according to claim 16, wherein the drawer (40) extends immediately below the tray (19).

24. The refrigerator and/or freezer (100) with at least one supporting tray (10, 12, 14, 16, 18) and with a transport lock which is provided at a front, open side of the refrigerator and/or freezer, and which includes a region in which one or more slotted receptacles or holes (32) extending through the transport lock (30) are provided for receiving portions of the supporting tray(s) (10, 12, 14, 16, 18), wherein the transport lock (30) is configured to be foldable into triangular, semicircular or trapezoidal cross-section with said receptacles (32) extending along and through a folded side of said transport lock (30).

* * * * *